United States Patent [19]

Hunt, III

[11] 4,415,031

[45] Nov. 15, 1983

[54] USE OF RECYCLED COMBUSTION GAS DURING TERMINATION OF AN IN-SITU COMBUSTION OIL RECOVERY METHOD

[75] Inventor: William C. Hunt, III, Farmers Branch, Tex.

[73] Assignee: Mobil Oil Corporation, New York, N.Y.

[21] Appl. No.: 357,367

[22] Filed: Mar. 12, 1982

[51] Int. Cl.[3] ..... E21B 43/243

[52] U.S. Cl. ..... 166/261; 166/251; 166/266

[58] Field of Search ..... 166/261, 266, 267, 251

[56] References Cited

U.S. PATENT DOCUMENTS

| | | | |
|---|---|---|---|
| 2,630,307 | 3/1953 | Martin | 166/266 X |
| 2,788,071 | 4/1957 | Pelzer | 166/261 |
| 3,032,102 | 5/1962 | Parker | 166/251 |
| 3,196,945 | 7/1965 | Craig, Jr. et al. | 166/261 |
| 3,964,545 | 6/1976 | Speller, Jr. | 166/266 X |
| 4,042,026 | 8/1977 | Pusch et al. | 166/261 X |
| 4,059,152 | 11/1977 | Allen et al. | 166/261 |
| 4,252,191 | 2/1981 | Pusch et al. | 166/261 |

*Primary Examiner*—Stephen J. Novosad
*Attorney, Agent, or Firm*—Alexander J. McKillop; James F. Powers, Jr.; Lawrence O. Miller

[57] ABSTRACT

A method for recovering viscous oil from a subterranean, viscous oil-containing formation by initiating an in-situ combustion operation in the formation using a mixture of oxygen and an inert gas having a low oxygen concentration, preferably about 21 vol. %. After a predetermined period of time, the oxygen concentration is increased to a predetermined higher level, preferably within the range of 95 to 99.5 vol. %. Once the oxygen concentration has reached the desired value, water may be simultaneously injected continuously or intermittently. After a predetermined period of time, produced combustion gas enriched in carbon dioxide separated from the produced oil is compressed and recycled as a diluent for the injected oxygen in place of the inert gas. Thereafter, wet in-situ combustion operation is continued and the oxygen concentration of the injected mixture of oxygen and combustion gas diluent is maintained at a predetermined value so that the concentration of oxygen in the produced combustion gas is maintained at a predetermined value low enough to avoid the danger of an explosion or burning of the production well. After a predetermined period of time, injection of oxygen is terminated and injection of produced combustion gas and water is continued until the combustion front in the formation is discontinued. Finally, water is injected to scavenge heat in the formation. In-situ combustion may be initiated using air followed by injection of a mixture of oxygen and an inert gas having a predetermined oxygen concentration greater than air, preferably 95 to 99.5 vol. %.

34 Claims, 1 Drawing Figure

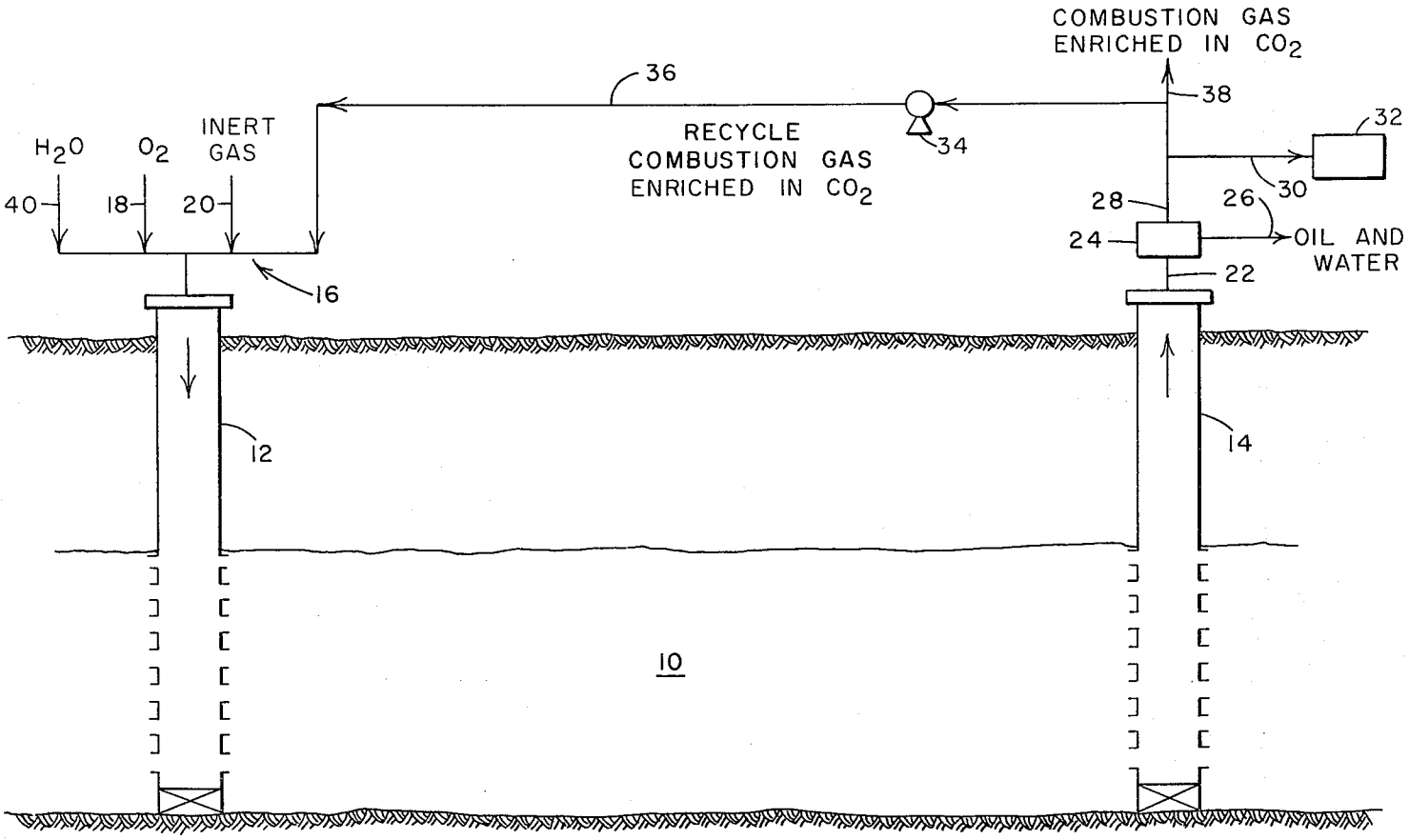
COMBUSTION GAS ENRICHED IN $CO_2$
38
32
30
26
OIL AND WATER
22
28
24
14
34
RECYCLE COMBUSTION GAS ENRICHED IN $CO_2$
36
10
16
INERT GAS
20
$O_2$
18
$H_2O$
40
12

USE OF RECYCLED COMBUSTION GAS DURING TERMINATION OF AN IN-SITU COMBUSTION OIL RECOVERY METHOD

FIELD OF AND BACKGROUND OF THE INVENTION

1. Field of the Invention

This invention relates to the in-situ combustion of a subterranean, viscous oil-containing formation for the recovery of oil. More paticularly, the present invention is an in-situ combustion method for the recovery of viscous oil from subterranean, viscous oil-containing formations wherein the in-situ combustion operation is initially conducted using the injection of a mixture of oxygen and an inert gas with a predetermined low oxygen concentration, increasing the oxygen concentration to a predetermined higher concentration, and subsequently injecting a mixture of oxygen and recycled produced combustion gas enriched in carbon dioxide with a predetermined oxygen concentration so as to eliminate safety problems associated with the production of high concentrations of oxygen from the associated production wells.

2. BACKGROUND OF THE INVENTION

A variety of supplemental recovery techniques have been employed in order to increase the recovery of viscous oil from subterranean viscous oil-containing formations. These techniques include thermal recovery methods, waterflooding and miscible flooding.

Of the aforementioned recovery methods, in-situ combustion appears to be the most promising method of economically recovering large amounts of viscous hydrocarbon deposits with currently available technology. The attractiveness of the in-situ combustion method arises primarily from the fact that it requires relatively little energy necessary for sustaining combustion of the hydrocarbon deposits. In contradistinction, other in-situ techniques, such as electrical resistance heating and steam injection require considerable amounts of energy, e.g., to heat the steam at the surface before it is injected into the viscous oil-containing formation.

Conventional in-situ combustion involves drilling of at least two substantially vertical wells into the formation, the wells being separated by a horizontal distance within the formation. One of the wells is designated an injection well, and the other a production well. The recovery of oil is accomplished by raising the temperature of the in-place oil adjacent the injection well to combustion temperatures by some suitable means, e.g., with some type of a conventional down hole heater/-burner apparatus, or by steam injection and then supporting combustion by injecting an oxygen-containing gas such as air, oxygen enriched air, oxygen mixed with an inert gas, or substantially pure oxygen. Thereafter, the injection of the oxygen-containing gas is continued so as to maintain the high temperature combustion front which is formed, and to drive the front through the formation toward the production well. As the combustion front moves through the formation, it displaces ahead of it the in-place oil reduced in viscosity as well as other formation fluids such as water and also combustion gas produced during the combustion process and these fluids are recovered from the formation via the production well.

As an improvement in the in-situ combustion operation, water or steam may be injected either simultaneously or intermittently with the oxygen-containing gas to scavenge the residual heat in the formation behind the combustion and to maintain reservoir pressure, thereby increasing recovery of oil. This is sometimes referred to as wet combustion.

The use of oxygen enriched air or substantially pure oxygen for in-situ combustion operations is being seriously considered as an alternate strategy to air combustion. One of the disadvantages of this process is the danger of working with high purity oxygen in and around an oilfield environment. One danger which must be addressed is the possibility of contacting high concentrations of oxygen with the produced oil in a production well (where conditions are still hot) or in flow lines.

U.S. Pat. No. 4,042,026 to Pusch et al. discloses a method for initiating an in-situ combustion operation to eliminate the dangerous place of injecting oxygen whereby igniters are injected into the upper region of the formation and an inert gas is injected into the lower region of the formation, and thereafter an oxygen-containing gas is injected at a predetermined oxygen concentration and rate to initiate combustion, followed by increasing the oxygen concentration and/or rate of the injected gas to a maximum value.

Accordingly, it is a primary object of this invention to provide an improvement in the prior art in-situ combustion processes to eliminate the safety problem associated with the production of high concentrations of oxygen at the production wells.

SUMMARY OF THE INVENTION

This invention relates to an improved in-situ combustion method for recovering viscous oil from a subterranean, viscous oil-containing formation using a mixture of substantially pure oxygen and an inert gas diluent at predetermined oxygen concentration levels and in a later stage of the process utilizing recovered combustion gas enriched in carbon dioxide. The oxygen concentration levels of the injected gas are maintained at the maximum level while maintaining the concentration of oxygen in the production well at a sufficiently low concentration so as to eliminate the possibility of an explosion therein or burning of the production well. In this method, an in-situ combustion reaction is initiated in the viscous oil-containing formation using a mixture of oxygen and an inert gas such as nitrogen, carbon dioxide, or mixtures thereof as a diluent at a predetermined low oxygen concentration level, preferably about 21 vol. %, approximating that of air. In-situ combustion is continued using this injected gas to propagate the combustion front through the formation toward a production well and displace ahead of it fluids including oil reduced in viscosity, water, and combustion gas enriched in carbon dioxide which are recovered from the production well. After a predetermined period of time, the oxygen concentration of the injected gas is increased to a predetermined higher oxygen concentration, preferably within the range of 95 to 99.5 vol. %. During this step of the process, the oxygen concentration of the injected gas may be gradually increased to the desired value. When the oxygen concentration is increased to the desired value, water may be simultaneously or intermittently injected with the injected oxygen enriched gas. After a predetermined period of time or when the amount of oxygen in the combustion gas recovered from the formation via the production well reaches a predetermined level, a portion of the combustion gas enriched in carbon dioxide is recycled and injected as the diluent with the injected oxygen in place of the previously injected inert gas. In-situ combustion is continued and the concentration of oxygen in the injected gas is maintained at a predetermined value so that the concentration of oxygen in the produced combustion gas is maintained at a predetermined value low enough to avoid the danger of an explosion or burning of the production well. Thereafter, injection of oxygen is terminated and injection of combustion gas is continued until the combustion front is discontinued. Finally, water is injected into the formation to scavenge heat from the formation. In another embodiment of the process, air may be injected into the formation to initiate the in-situ combustion operation in place of a mixture of oxygen and an inert gas. After a predetermined period of time, injection of air is terminated and a mixture of oxygen and an inert gas is injected into the formation having a predetermined oxygen concentration greater than air, preferably 95 to 99.5 vol. %, for a predetermined period of time. Thereafter, the process is continued as previously described.

BRIEF DESCRIPTION OF THE DRAWING

The attached drawing depicts a subterranean, viscous oil-containing formation being subjected to the process of my invention.

DESCRIPTION OF THE PREFERRED EMBODIMENTS

The process of my invention may be best understood by referring to the attached drawing, in which a subterranean, viscous oil-containing formation 10 is penetrated by an injection well 12 and a spaced apart production well 14, both wells being in fluid communication with the formation. Injection well 12 is provided with a wellhead manifold generally shown by 16 having multiple injection means wherein various streams of fluids may be introduced simultaneously or intermittently into the injection well.

In the first step, an in-situ combustion operation is initiated in the formation 10 adjacent the injection well 12 using a combustion-supporting gas containing a predetermined low oxygen concentration, preferably about 21 vol. % oxygen. Referring to the drawing, substantially pure oxygen, up to 99.5%, flowing through line 18, is mixed with an inert gas, such as nitrogen, carbon dioxide or mixtures thereof, flowing from line 20. The oxygen and inert gas are mixed in well head manifold generally indicated at 16 and the mixture is injected into the viscous-oil containing formation 10 via the injection well 12. The oxygen/inert gas ratio is adjusted so that the oxygen concentration of the resulting gaseous mixture injected into the formation is at a predetermined low value, preferably about 21 vol. % oxygen. In-situ combustion of a portion of the oil adjacent the injection well 12 is then initiated by conventional means to establish a combustion front and generate combustion gas formed by the oxidation reaction with the carbonaceous formation materials. This oxidation reaction produces a combustion gas enriched in carbon dioxide and includes additional gases such as oxygen. Injection of the oxygen/inert gaseous mixture is continued as as to advance the combustion front through the formation 10 towards the production well 12.

During the in-situ combustion operation, the heat generated by combustion reduces the viscosity of the oil in the formation and the combustion front displaces ahead of it mobilized oil, water, and combustion gas formed by the oxidation processes that have occurred within the formation 10 toward the production well 14 from which fluids including oil, water, and produced combustion gas are recovered via the production well. The fluids recovered from production well 14 via line 22 are passed into a separator 24 so as to remove the oil and water from the produced combustion gas. Oil and water are recovered from separator 24 through line 26 and the produced combustion gas enriched in carbon dioxide is withdrawn through line 28. A small portion of combustion gas is withdrawn through line 30 and introduced into an analyzer 32 wherein the composition of the combustion gas is determined, particularly for the presence of oxygen. A portion of the combustion gas enriched in carbon dioxide is withdrawn from line 28 and recycled through a compressor 34 to form compressed combustion gas in line 36 which may be subsequently combined with the injected oxygen as a diluent in place of the inert gas and introduced back into the formation 10 via injection well 12. The remaining portion of the combustion gas passes through line 38 and is stored in appropriate containers (not shown) or disposed of in a conventional manner.

In-situ combustion is continued while maintaining the injected oxygen concentration at about 21 vol. % oxygen using a mixture of oxygen and an inert gas for a predetermined period of time. Thereafter, the oxygen concentration of the injected gas is increased to a higher predetermined value, preferably within the range of 95 to 99.5 vol. %, and in-situ combustion is continued using the oxygen enriched gas. During this step of the process, the oxygen concentration of the injected gas may be gradually increased to the desired value. Once the in-situ combustion operation is commenced using the higher concentration of oxygen, water is simultaneously injected into the injection well 12 via line 40 and well head manifold 16. The water/oxygen ratio should be within the range of 2.5 to 5 barrels/1000 SCF $O_2$. The water may be injected continuously or intermittently. Instead of injecting the water with the combustion supporting gas simultaneously through well head manifold 16 via line 40, the water may be introduced into the injection well 12 through a separate string of tubing (not shown) that extends into the injection well. Alternatively, the water may be injected into a separate injection well (not shown) adjacent to injection well 12.

The oxygen concentration is preferably increased to the range of 95 to 99.5% when the in-situ combustion operation has continued for a sufficient period of time to permit the combustion front to advance a sufficient distance from the injection well so that there is no residual oil surrounding the injection well. The presence of residual oil in the injection well during injection of high concentration of oxygen creates a hazardous condition and could result in an explosion.

Wet in-situ combustion using the high oxygen concentration gas is continued for a predetermined period of time and fluids including oil, water, and combustion gas are recovered from production well 14.

After a predetermined period of time, produced combustion gas enriched in carbon dioxide recovered from the formation via production well 14 is recycled as a diluent for the injected oxygen in place of the inert gas introduced from line 20. When sufficient produced combustion gas is available, injection of inert gas via line 20 is terminated and produced combustion gas enriched in carbon dioxide is withdrawn from line 28 and recycled through a compressor 34 to form compressed combustion gas in line 36 that is transported to wellhead manifold 16 where it is mixed with oxygen from line 18, and water from line 40. Wet in-situ gas combustion is continued using the mixture of oxygen and combustion gas injected into the formation via injection well 12 at a predetermined oxygen concentration. The combustion gas, enriched in carbon dioxide, not only serves as a diluent, but it also enhances oil production by dissolving in the viscous oil in the formation and reducing its viscosity. Also, carbon dioxide is a better diluent gas from a safety standpoint than nitrogen.

As the combustion front advances closer to the production well 14, there is an increased danger of an explosion due to the possibility of produced oil in the production well (where conditions are still hot) or in the flow line contacting high concentrations of oxygen. To eliminate this safety problem, the presence of oxygen in the combustion gas recovered from the production well 14 is constantly monitored by withdrawing a sample of gas through line 30 and measuring the amount of oxygen therein by gas analyzer 32. When the amount of oxygen in the combustion gas increases to a predetermined level, the concentration of oxygen injected into the formation 10 via injection well 12 is reduced by increasing the amount of injected combustion gas diluent from line 36. Sufficient combustion gas is recycled via line 36 and mixed with the injected oxygen via line 18 so that the oxygen concentration of the injected gas is maintained at a predetermined value so that the concentration of oxygen in the produced combustion gas is maintained at a predetermined value low enough to avoid the danger of an explosion or burning of the production well 14. The control of the oxygen/combustion gas ratio may be activated by a suitable system (not shown) used in conjunction with gas analyzer 32. The oxygen concentration of the injected gas may therefore be gradually decreased or reduced to zero to maintain a safe concentration of oxygen in the produced combustion gas.

After the oxygen concentration has been reduced to a predetermined level or reduced to zero, injection of oxygen is terminated and injection of combustion gas via lines 36 and water via line 40 into injection well 12 are continued to drive the remaining oxygen in the formation to the combustion zone. Injection of the combustion gas and water are continued until the combustion front is discontinued. Thereafter, injection of the combustion gas via line 36 is terminated and injection of water via line 40 is continued to scavenge heat from the formation. Production of oil is continued via production well 14 until the amount of oil recovered is unfavorable.

It is to be understood that although the process has been described as a wet in-situ combustion operation, it can be conducted without the injection of water. Wet in-situ combustion is the preferred embodiment because the larger steam front assists in maintaining formation pressure and also scavenges heat from the formation.

In another embodiment of the present invention, the in-situ combustion operation may be initiated using air instead of a mixture of oxygen as an inert gas having a predetermined low oxygen concentration of about 21 vol. %. After a predetermined amount of time, injection of air is terminated and a mixture of oxygen and an inert gas having a predetermined oxygen concentration greater than air, preferably within the range of 95 to 99.5 vol. %, is injected into the injection well to support in-situ combustion. During this step of the process, the oxygen concentration of the injected gas may be gradually increased to the desired value. Thereafter the process is continued as previously described including the steps of injecting water, recycling produced gas enriched in carbon dioxide as a diluent for the injected oxygen in place of the inert gas and controlling the oxygen/produced gas diluent ratio so that the concentration of oxygen in the produced combustion gas is maintained at a safe level.

While the invention has been described in terms of a single injection well and a single spaced apart production well, the method according to the invention may be practiced using a variety of well patterns. Any other number of wells, which may be arranged according to any pattern, may be applied in using the present method as illustrated in U.S. Pat. No. 3,927,716 to Burdyn et al., the disclosure of which is hereby incorporated by reference.

From the foregoing specification one skilled in the art can readily ascertain the essential features of this invention and without departing from the spirit and scope thereof can adopt it to various diverse applications. It is my intention that my invention be limited and restricted only by those limitations and restrictions as appear in the appended claims.

What is claimed is:

1. In a method for the recovery of viscous oil from a subterranean, viscous oil-containing formation penetrated by at least one injection well and at least one spaced-apart production well, said injection well and said production well in fluid communication with said formation, comprising:

(a) injecting into the formation via said injection well a mixture of oxygen and an inert gas having a predetermined low oxygen concentration to initiate an in-situ combustion operation adjacent said injection well resulting in the formation of a combustion front in the oil-containing formation and production of a combustion gas predominantly containing carbon dioxide;

(b) continuing the injection of said mixture of oxygen and an inert gas for a predetermined period of time to advance the combustion front toward said production well;

(c) recovering fluids including oil and the combustion gas enriched in carbon dioxide from the formation via said production well;

(d) separating said oil from said combustion gas enriched in carbon dioxide;

(e) increasing the oxygen concentration of said injected gaseous mixture to a predetermined level and continuing injection of said gas for a predetermined period of time;

(f) injecting a mixture of oxygen and said combustion gas enriched in carbon dioxide recovered from the formation having a predetermined oxygen concentration and continuing injection of said mixture for a predetermined period of time;

(g) maintaining the oxygen concentration of said injected mixture of oxygen and combustion gas at a predetermined level so that the concentration of oxygen in the combustion gas is maintained at a predetermined value low enough to avoid the danger of an explosion or burning of the production well;

(h) terminating injection of oxygen when the oxygen concentration of the injected gas is reduced to a predetermined value and continuing to inject combustion gas until the combustion front is discontinued; and (i) continuing to recover fluids including oil from the formation via said production well.

2. The method of claim 1 wherein water is simultaneously injected during steps (b) thru (h).

3. The method of claim 1 wherein water is intermittently injected during steps (b) thru (h).

4. The method of claim 2 or 3 wherein the $H_2O/O_2$ ratio is from 2.5 to 5 barrels/1000 SCF $O_2$.

5. The method of claim 1 wherein the oxygen concentration of the gas injected into the formation during step (a) is about 21 vol. %.

6. The method of claim 1 wherein the oxygen concentration of the gas injected into the formation during step (e) is within the range of 95 to 99.5 vol. %.

7. The method of claim 1 wherein the injection of the gas during step (b) is continued until the combustion front has advanced a sufficient distance from the injection well that there is substantially no residual oil in this zone.

8. The method of claim 1 wherein the inert gas is nitrogen, carbon dioxide, and mixture thereof.

9. The method of claim 1 wherein step (h) is followed by injection of water to scavenge heat from the formation.

10. The method of claim 1 wherein the oxygen concentration of the injected gas during step (e) is gradually increased to the desired value.

11. In a method for the recovery of viscous oil from a subterranean, viscous oil-containing formation penetrated by at least one injection well and a spaced-apart production well, comprising:

(a) initially injecting a mixture of oxygen and an inert gas with a predetermined low oxygen concentration into the formation via said injection well to establish an in-situ combustion front in the oil-containing formation;

(b) continuing injection of said gaseous mixture until the combustion front has been moved a predetermined distance into the formation;

(c) thereafter increasing the oxygen concentration of said gaseous mixture to a predetermined value;

(d) simultaneously injecting water into the formation via said injection well;

(e) continuing to inject said gaseous mixture into said formation until the combustion front has moved a predetermined distance into the formation;

(f) thereafter injecting a mixture of oxygen and combustion gas enriched in carbon dioxide recovered from the formation via said production well, said gaseous mixture having a predetermined oxygen concentration;

(g) maintaining the oxygen concentration of said gaseous mixture at a predetermined value so that the concentration of oxygen in the produced combustion gas is maintained at a predetermined value low enough to avoid the danger of an explosion or burning of the production well;

(h) terminating injection of oxygen when the oxygen concentration of the injected gas is reduced to a predetermined value and continuing to inject combustion gas and water until the combustion front in the formation is discontinued;

(i) terminating the injection of produced combustion gas and continuing injection of water to scavenge heat in the formation; and (j) recovering fluids including oil from the formation via said production well.

12. The method of claim 11 wherein the $H_2O/O_2$ ratio is from 2.5 to 5 barrels/1000 SCF $O_2$.

13. The method of claim 11 wherein the water injection during in-situ combustion is intermittent.

14. The method of claim 11 wherein the oxygen concentration during step (a) is about 21 vol. %.

15. The method of claim 11 wherein the oxygen concentration during step (c) is within the range of 95 to 99.5 vol. %.

16. The method of claim 11 wherein the injection of the combustion supporting gas during step (b) is continued until the combustion front has advanced a sufficient distance from the injection well that there is substantially no residual oil in this zone.

17. The method of claim 11 wherein the inert gas is nitrogen, carbon dioxide, and mixtures thereof.

18. The method of claim 11 wherein the oxygen concentration of the injected gas during step (c) is gradually increased to the desired value.

19. In a method for the recovery of viscous oil from a subterranean, viscous oil-containing formation penetrated by at least one injection well and at least one spaced-apart production well, said injection well and said production well in fluid communication with said formation, comprising:

(a) injecting air into the formation via said injection well to initiate an in-situ combustion operation adjacent said injection well resulting in the formation of a combustion front in the oil-containing formation and production of a combustion gas predominantly containing carbon dioxide;

(b) continuing the injection of said air for a predetermined period of time to advance the combustion front toward said production well;

(c) recovering fluids including oil and the combustion gas enriched in carbon dioxide from the formation via said production well;

(d) separating said oil from said combustion gas enriched in carbon dioxide;

(e) injecting into the formation via said injection well a mixture of oxygen and an inert gas having a predetermined oxygen concentration greater than air and continuing injection of said gas for a predetermined period of time;

(f) injecting a mixture of oxygen and said combustion gas enriched in carbon dioxide recovered from the formation having a predetermined oxygen concentration and continuing injection of said mixture for a predetermined period of time;

(g) maintaining the oxygen concentration of said injected mixture of oxygen and combustion gas at a predetermined level so that the concentration of oxygen in the combustion gas is maintained at a predetermined value low enough to avoid the danger of an explosion or burning of the production well;

(h) terminating injection of oxygen when the oxygen concentration of the injected gas is reduced to a predetermined value and continuing to inject combustion gas until the combustion front is discontinued; and (i) continuing to recover fluids including oil from the formation via said production well.

20. The method of claim 19 wherein water is simultaneously injected during steps (b) thru (h).

21. The method of claim 19 wherein water is intermittently injected during steps (b) thru (h).

22. The method of claim 20 or 21 wherein the $H_2O/O_2$ ratio is from 2.5 to 5 barrels/1000 SCF $O_2$.

23. The method of claim 19 wherein the oxygen concentration of the gas injected into the formation during step (e) is within the range of 95 to 99.5 vol. %.

24. The method of claim 19 wherein the injection of the gas during step (b) is continued until the combustion front has advanced a sufficient distance from the injection well that there is substantially no residual oil in this zone.

25. The method of claim 19 wherein the inert gas is nitrogen, carbon dioxide, and mixtures thereof.

26. The method of claim 19 wherein the oxygen concentration of the injected gas during step (e) is gradually increased to the desired value.

27. The method of claim 19 wherein step (h) is followed by injection of water to scavenge heat from the formation.

28. In a method for the recovery of viscous oil from a subterranean, viscous oil-containing formation penetrated by at least one injection well and at least one spaced-apart production well, said injection well and said production well in fluid communication with said formation, comprising:

(a) initially injecting air into the formation via said injection well to establish an in-situ combustion front in the oil-containing formation;

(b) continuing injection of said air until the combustion front had been moved a predetermined distance into the formation;

(c) thereafter injecting a mixture of oxygen and an inert gas into the formation via said injection well having a predetermined oxygen concentration greater than air;

(d) simultaneously injecting water into the formation via said injection well;

(e) continuing to inject said gaseous mixture into said formation until the combustion front has moved a predetermined distance into the formation;

(f) thereafter injecting a mixture of oxygen and combustion gas enriched in carbon dioxide recovered from the formation via said production well, said gaseous mixture having a predetermined oxygen concentration;

(g) maintaining the oxygen concentration of said gaseous mixture at a predetermined value so that the concentration of oxygen in the produced combustion gas is maintained at a predetermined value low enough to avoid the danger of an explosion or burning of the production well;

(h) terminating the injection of oxygen when the oxygen concentration of the injected gas is reduced to a predetermined value and continuing to inject combustion gas and water until the combustion front in the formation is discontinued;

(i) terminating the injection of produced combustion gas and continuing injection of water to scavenge heat in the formation; and (j) recovering fluids including oil from the formation via said production well.

29. The method of claim 28 wherein the $H_2O/O_2$ ratio is from 2.5 to 5 barrels/1000 SCF $O_2$.

30. The method of claim 28 wherein the water injection during in-situ combustion is intermittent.

31. The method of claim 28 wherein the oxygen concentration during step (c) is within the range of 95 to 99.5 vol.%.

32. The method of claim 28 wherein the injection of the combustion supporting gas during step (b) is continued until the combustion front has advanced a sufficient distance from the injection well that there is substantially no residual oil in this zone.

33. The method of claim 28 wherein the inert gas in nitrogen, carbon dioxide, and mixtures thereof.

34. The method of claim 28 wherein the oxygen concentration of the injected gas during step (c) is gradually increased to the desired value.

* * * * *